US010486846B2

(12) United States Patent
Magee

(10) Patent No.: US 10,486,846 B2
(45) Date of Patent: Nov. 26, 2019

(54) BAG DISPENSING SYSTEM

(71) Applicant: CARLTON PACKAGING LLP, Milton Keynes (GB)

(72) Inventor: Marcus James Magee, Stanbridge (GB)

(73) Assignee: CARLTON PACKAGING LLP, Milton Keynes (GB)

( * ) Notice: Subject to any disclaimer, the term of this patent is extended or adjusted under 35 U.S.C. 154(b) by 0 days.

(21) Appl. No.: 16/060,891

(22) PCT Filed: Nov. 30, 2016

(86) PCT No.: PCT/GB2016/053767
§ 371 (c)(1),
(2) Date: Jun. 8, 2018

(87) PCT Pub. No.: WO2017/098213
PCT Pub. Date: Jun. 15, 2017

(65) Prior Publication Data

US 2018/0362203 A1 Dec. 20, 2018

(30) Foreign Application Priority Data

Dec. 9, 2015 (GB) ..... 1521708.6

(51) Int. Cl.
*B65B 67/12* (2006.01)
*B65D 33/00* (2006.01)
(Continued)

(52) U.S. Cl.
CPC ..... *B65B 67/1266* (2013.01); *A47F 13/085* (2013.01); *B65B 43/14* (2013.01); *B65D 33/001* (2013.01); *B65D 33/14* (2013.01)

(58) Field of Classification Search
CPC ... B65B 67/1266; B65B 43/14; A47F 13/085; B65D 33/001; B65D 33/14
(Continued)

(56) References Cited

U.S. PATENT DOCUMENTS 1,700,641 A * 1/1929 Medlock ..... A47F 13/085 211/57.1
3,044,233 A * 7/1962 Altman, Jr. ..... B65B 25/16 141/392
(Continued)

FOREIGN PATENT DOCUMENTS

| | | |
|---|---|---|
| DE | 3912847 | 4/1989 |
| EP | 0005044 | 10/1979 |
| EP | 1174357 | 1/2002 |

OTHER PUBLICATIONS

European Patent Office, "Notification of Transmittal of the ISR and the Written Opinion of the International Searching Authority, or the Declaration," in PCT Application No. PCT/GB2016/053767, dated Feb. 13, 2017, 11 pages.
(Continued)

*Primary Examiner* — Jacob K Ackun
*Assistant Examiner* — Jenine Pagan
(74) *Attorney, Agent, or Firm* — Kang S. Lim

(57) ABSTRACT

A dispensing system for mailing and other bags comprises a plurality of bags (10) arranged as a stack, each bag being frangibly connected along their upper side edge at (15) to a header (16), and a fastener (18) extending through the header (16) of each bag for securing the bags (10) together into an assembly, the system further comprising hanger (24) for supporting the bag assembly, the hanger (24) comprising a formation (26) arranged to engage a complimentary formation (20) on the rear of the fastener (18). The hanger (24) can be permanently fixed to a support structure and the assembly of bag (10) is then fitted to the hanger by engaging
(Continued)

the formation (20) on the fastener with the complimentary formation (26) on the hanger (24). The bags (10) then hang from the hanger (24) in such a way that they can easily and singlehandedly be opened and detached by pulling them away from their header (16).

5 Claims, 2 Drawing Sheets

(51) Int. Cl.
*B65D 33/14* (2006.01)
*A47F 13/08* (2006.01)
*B65B 43/14* (2006.01)

(58) Field of Classification Search
USPC ..... 206/554, 806; 383/6, 9, 12, 13, 14, 15, 383/21, 22, 23, 32, 37
See application file for complete search history.

(56) References Cited

U.S. PATENT DOCUMENTS 3,100,569 A * 8/1963 White ..... B65D 33/001 141/10
3,198,325 A * 8/1965 White ..... B65D 33/001 206/451
3,312,339 A * 4/1967 Million ..... B65D 33/001 206/493
4,241,561 A * 12/1980 Suominen ..... A47F 13/085 53/384.1
5,524,762 A 6/1996 Shafran et al.
7,080,756 B2 * 7/2006 Cunningham ..... A47F 9/042 206/554
8,016,111 B2 * 9/2011 Wilson ..... A45F 5/1046 206/493
8,387,783 B2 * 3/2013 Zack ..... A47K 3/001 206/77.1
2003/0004047 A1 * 1/2003 Stienecker ..... B65D 33/001 493/204
2005/0072712 A1 4/2005 Strickland
2008/0197245 A1 * 8/2008 Weldon ..... A47F 13/085 248/95

OTHER PUBLICATIONS

U.K. Intellectual Property Office, GB Application No. GB 1521708.6, "Search Report under Section 17(5)" dated Feb. 15, 2016, 3 pages.
U.K. Intellectual Property Office, GB Application No. GB 1521708.6, "Examination Report under Section 18(3)" dated Sep. 1, 2017, 3 pages.
U.K. Intellectual Property Office, GB Application No. GB 1521708.6, "Examination Report under Section 18(3)" dated Jan. 30, 2019, 4 pages.

* cited by examiner

BAG DISPENSING SYSTEM

CROSS-REFERENCE TO RELATED APPLICATIONS

The present application is a United States National Stage entry under 35 U.S.C. § 371 of International Application No. PCT/GB2016/053767 filed Nov. 30, 2016, designating the United States of America and published in English on Jun. 15, 2017, which in turn claims priority to Great Britain Application No. 1521708.6, filed on Dec. 9, 2015, all of which are incorporated herein by reference in their entirety.

This invention relates to a system for dispensing bags, such as polythene bags for packaging purposes.

The sending of documents and other items by mail and other delivery services is becoming increasingly wide spread. Often the items to be sent are placed in polythene mailing bags by the dispatcher. Typically, the retrieval and opening of such bags is a two-handed operation, which is both difficult and time consuming especially if the dispatcher is dispatching a large volume of items.

US20050072712 discloses a pad of delivery bags which can be fixed in a variety of different ways to a hanger.

DE3912847 discloses a bag dispensing system comprising a plurality of delivery bags, each being frangibly connected along its upper side edge to a header. The bags are fixed in a stack to a hanger by passing expandable fasteners through the headers, which engage into corresponding apertures on the hanger.

During transportation, it is easy for the fasteners to become dislodged prior to fitting the bags to the hanger, with the result that the user has the inconvenience of threading the bags back onto the fasteners prior to fitting to the hanger. Once the bags are exhausted, it is then difficult to remove the headers from the hanger because the fasteners must be snapped across defined lines of weakness.

We have now devised a bag dispensing system which alleviates the above-mentioned problems.

In accordance with the present invention, there is provided a bag dispensing system comprising a plurality of bags arranged as a stack, each bag being frangibly connected along their upper side edge to a header, and a fastener extending through the header of each bag for securing the bags together into an assembly, the system further comprising hanger for supporting the bag assembly, the hanger comprising a formation arranged to engage a complimentary formation on the rear of the fastener, the fastener comprising a stem which extends between a pair of enlarged heads, the stem extending through an aperture in each header and the heads serving to constrain the headers on the stem, said fastener formation being provided one of the heads.

The heads of the fastener securely hold the bags together in a stack prior to fitting the bag assembly to the hanger. In this manner, pre-assembled bag assemblies can be shipped to user in cartons without the risk of any bags becoming separated from the fasteners, so that users can simply and quickly take an assembly from the shipping carton and hang it in-situ by engaging the formation on its fastener with the complimentary formation on the hanger. The bags then hang from the hanger in such a way that they can easily and singlehandedly be opened and detached by pulling them away from their header.

Once the supply of bags is exhausted, the dispatcher can simply detach the assembly from the hanger and attach another one.

Preferably each bag comprises a front sheet and a rear sheet, which are joined around their side and lower end edges, wherein only the rear sheet is attached to the header along its upper side edge, the upper side edge of the front sheet being free, the formation on the fastener being arranged such that the front sheet of the bags faces forwardly and is presented to the user. In use, because upper side edge of the front sheet is free and is presented to the user, the bag can be opened with one hand and the item placed in the bag with the user's other hand. The bag can then be detached from the header by pulling it down and tearing it away. The next bag is then conveniently presented to the user.

Preferably the upper end of the rear sheet forms a flap for closing the bag.

Preferably the heads are provided on respective portions of the fastener which are interconnected following insertion of the stem through the headers. Preferably the portions are captively interconnected, such that they cannot readily be separated so as prevent the fastener being re-used.

Preferably the assembly comprises a plurality of fasteners.

Preferably the hanger formation comprises a channel into which the fastener formation can be inserted.

Preferably formations on the hanger and fastener are arranged to resiliently engage each other, so as to prevent them from inadvertently separating in use.

An embodiment of the present invention will now be described by way of an example only and with reference to the accompanying drawings, in which.

Figure 1:
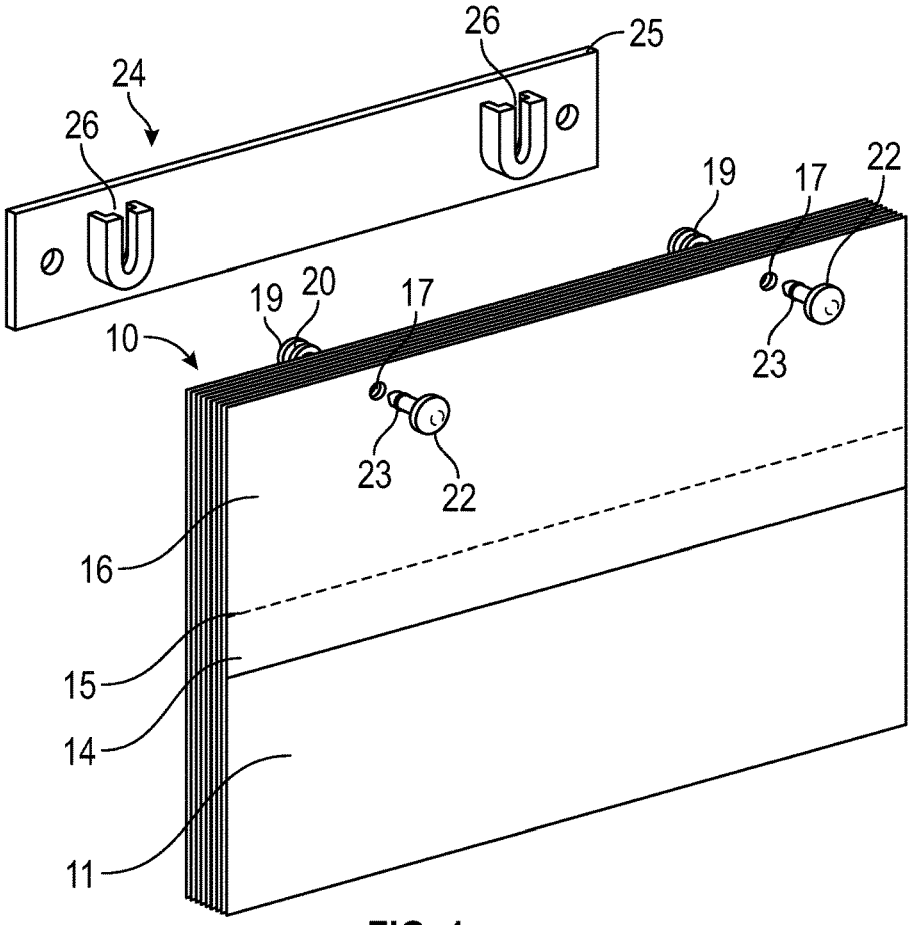
FIG. 1 is a perspective exploded view of an embodiment of bag dispensing system in accordance with the present invention.
Figure 2:
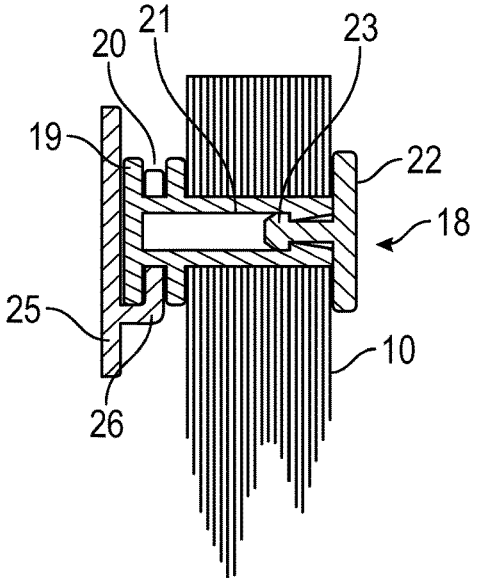
FIG. 2 is a sectional view through a fastener of the system of FIG. 1, when fitted to a plurality of bags.
Figure 3:
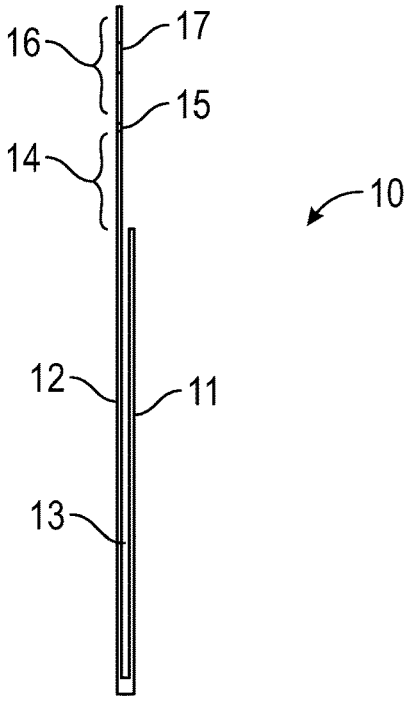
FIG. 3 is a sectional view through a bag of the system of FIG. 1.

Referring to FIGS. 1 to 3 of the drawings, there is shown a bag dispensing system comprising a plurality of bags 10. Each bag 10 bag comprises a front sheet 11 and a rear sheet 12, which are joined around their side and lower end edges to form a compartment 13. The upper side edge of the front sheet 11 is free to provide an opening into the compartment 13. The upper side of the rear sheet 12 is extended to form a flap 14. The upper side edge of the flap 14 is perforated at 15 where it meets a header strip 16. Apertures 17 are formed at opposite ends of the header strip 16.

A fastener 18 comprises a circular rear head portion 19 formed with a circumferential groove 20. A tubular shaft 21 extends axially forwardly of the head 19. The fastener 18 also comprises a circular front head 22 portion formed with barbed projection 23 which extends axially rearwardly.

The bags 10 are fixed together in a stack by two fasteners 18 by inserting their shafts 21 through respective apertures 17 in the header 16. The bags 10 are then locked in-situ by inserting the barbed projection 23 into the front end of the tubular shaft 21, such that the bags 10 are constrained on the shaft 21 by the front and rear heads 22, 19.

A hanger 24 comprises a back plate 25 for fixing to a wall or other vertical surface. The front of the back plate 25 comprises a pair of U-shaped formations 26 which define vertically-extending channels which are open and closed at their upper and lower ends respectively.

In use, an assembly of bags is taken from a storage carton and hung on the hanger 24, which may be conveniently mounted adjacent a dispatcher's desk. The rear head portions 19 of the fasteners 18 engage into respective U-shaped formations 26, such that the front wall of the formations 26 slide are disposed inside respective grooves 20 of the fasteners.

The bags 10 are mounted such that their front sheets 11 are presented to the dispatcher. The upper side edge of the front sheet 11 forms a mouth, which can be opened by the dispatcher with one hand whilst the dispatcher's other hand places an item in the bag compartment 13. The bag 10 can then be detached from the header 16 by pulling it down and can causing it to tear along the perforated line 15. The next bag 10 is then conveniently presented to the dispatcher. The bag 10 can then be closed by adhering the flap 14 to the front surface of the front sheet 11.

Figure 4:
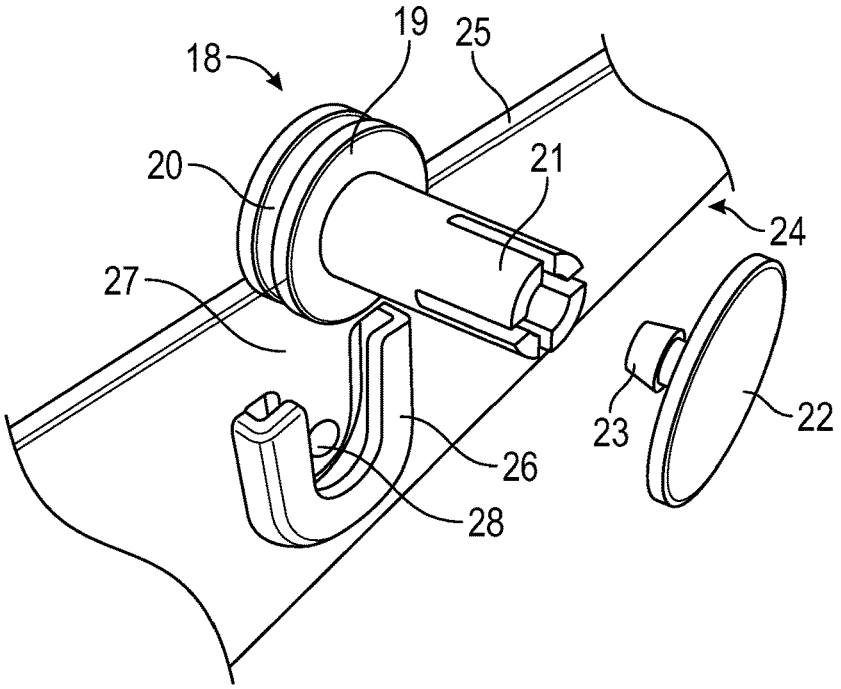
FIG. 4 is a perspective exploded view of a fastener and hanger of an alternative embodiment of bag dispensing system in accordance with the present invention.

Referring to FIG. 4 of the drawings, there is shown an alternative embodiment of bag dispensing system which is similar to the embodiment of FIGS. 1 to 3 and like parts are given like reference numerals. In this embodiment, each U-shaped formation comprises a rear wall having a resiliently flexible finger 27. The outer end of the finger 27 comprises a projection which engages into a corresponding recess in the rear surface of the rear head portion 19 of the fastener and locks it in-situ.

A bag dispensing system in accordance with the present invention is simple and inexpensive in construction, yet enables the bags to be filled in a quick and convenient manner.

The invention claimed is:

1. A bag dispensing system comprising a plurality of bags arranged as a stack, each bag being frangibly connected along an upper side edge thereof to a respective header, and a plurality of fasteners each comprising a stem which extends between enlarged front and rear heads, the stems of the fasteners extending through respective apertures in each header, the enlarged heads of each fastener serving to constrain the headers on the stem thereof to secure the bags together into a bag assembly the rear head of each fastener having a circumferential groove, the system further comprising a hanger for supporting the bag assembly, the hanger comprising a back plate having U-shaped formations which define respective vertically-extending channels into which the rear head of the respective fastener can be inserted, the channels being open at an upper end and closed at a lower end and are arranged to respectively engage the grooves on the rear head of respective fasteners, such that a front wall of each U-shaped formation is slidably received inside the groove of the respective fastener, each bag comprising a front sheet and a rear sheet, which are joined around their side and lower end edges, wherein only the rear sheet is attached to the header along its upper side edge, the upper side edge of the front sheet being free, the formation on the fastener being arranged such that the front sheet of the bags faces forwardly and is presented to the user.

2. A bag dispensing system as claimed in claim 1, in which the upper end of the rear sheet forms a flap for closing the bag.

3. A bag dispensing system as claimed in claim 1, in which the heads of each fastener are provided on respective portions thereof, the portions being interconnected following insertion of the stem through the headers.

4. A bag dispensing system as claimed in claim 2, in which the fastener portions are captively interconnected, such that they cannot readily be separated so as prevent the fastener being re-used.

5. A bag dispensing system as claimed in claim 1, in which the formations on the hanger and fastener are arranged to resiliently engage each other.

* * * * *